US010094547B2

(12) United States Patent
Hierzer

(10) Patent No.: US 10,094,547 B2
(45) Date of Patent: Oct. 9, 2018

(54) LIGHTING SYSTEM

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 0 days.

(21) Appl. No.: 15/454,455

(22) Filed: Mar. 9, 2017

(65) Prior Publication Data

US 2017/0261190 A1 Sep. 14, 2017

(30) Foreign Application Priority Data

Mar. 11, 2016 (DE) ..... 10 2016 204 042

(51) Int. Cl.

| | |
|---|---|
| ***F21V 23/00*** | (2015.01) |
| ***F21V 23/06*** | (2006.01) |
| ***F21V 3/06*** | (2018.01) |
| ***F21S 8/06*** | (2006.01) |
| ***F21V 21/005*** | (2006.01) |
| ***F21V 21/008*** | (2006.01) |

(Continued)

(52) U.S. Cl.

CPC ..... *F21V 23/06* (2013.01); *F21S 8/061* (2013.01); *F21S 8/063* (2013.01); *F21V 3/062* (2018.02); *F21V 21/005* (2013.01); *F21V 21/008* (2013.01); *F21V 21/104* (2013.01); *F21V 21/112* (2013.01); *F21V 23/001* (2013.01)

(58) Field of Classification Search

CPC ..... F21V 23/001; F21V 23/06; F21V 3/0436; F21V 21/005; F21V 21/008; F21V 21/104; F21V 21/112; F21S 8/061; F21S 8/063

See application file for complete search history.

(56) References Cited

U.S. PATENT DOCUMENTS

| | | | | |
|---|---|---|---|---|
| 3,739,319 | A | 6/1973 | Garnett | |
| 2013/0141904 | A1* | 6/2013 | Verfuerth | F21V 15/01 362/221 |
| 2017/0167707 | A1 | 6/2017 | Stanton et al. | |

FOREIGN PATENT DOCUMENTS

| | | | |
|---|---|---|---|
| DE | 1047940 | A | 12/1958 |
| DE | 2215888 | A | 10/1972 |
| DE | 9116786 | U1 | 12/1993 |

(Continued)

OTHER PUBLICATIONS

English Abstract for DE19801954, Publication Date: Jul. 22, 1999.

(Continued)

*Primary Examiner* — Thomas M Sember

(74) *Attorney, Agent, or Firm* — Millen, White, Zelano & Branigan, P.C.; William Nixon

(57) ABSTRACT

A lighting system has at least one luminaire having a connection portion, and has a fastening device, with a housing; an electrical contact-making connection, which can be detachably inserted into a supply connection of the luminaire, which supply connection is formed in the connection portion; at least one retaining pin, which has a securing portion, wherein the retaining pin, in a fitted state of the fastening device, extends through a slot formed in the connection portion of the luminaire, and the securing portion of the retaining pin is engaged behind a region of the connection portion that defines the slot; and a fastening portion for fastening a retaining cord and/or for connecting the terminals of an electrical supply cable.

16 Claims, 7 Drawing Sheets

(51) Int. Cl.
*F21V 21/104* (2006.01)
*F21V 21/112* (2006.01)

(56) References Cited

FOREIGN PATENT DOCUMENTS

| | | | |
|---|---|---|---|
| DE | 29814339 | U1 | 2/1999 |
| DE | 19801954 | A1 | 7/1999 |
| DE | 20005623 | U1 | 2/2001 |
| DE | 202010014200 | U1 | 12/2010 |
| EP | 3182001 | A1 | 6/2017 |

OTHER PUBLICATIONS

Search Report for related European Patent Application No. 17158364 dated Oct. 11, 2017.

* cited by examiner

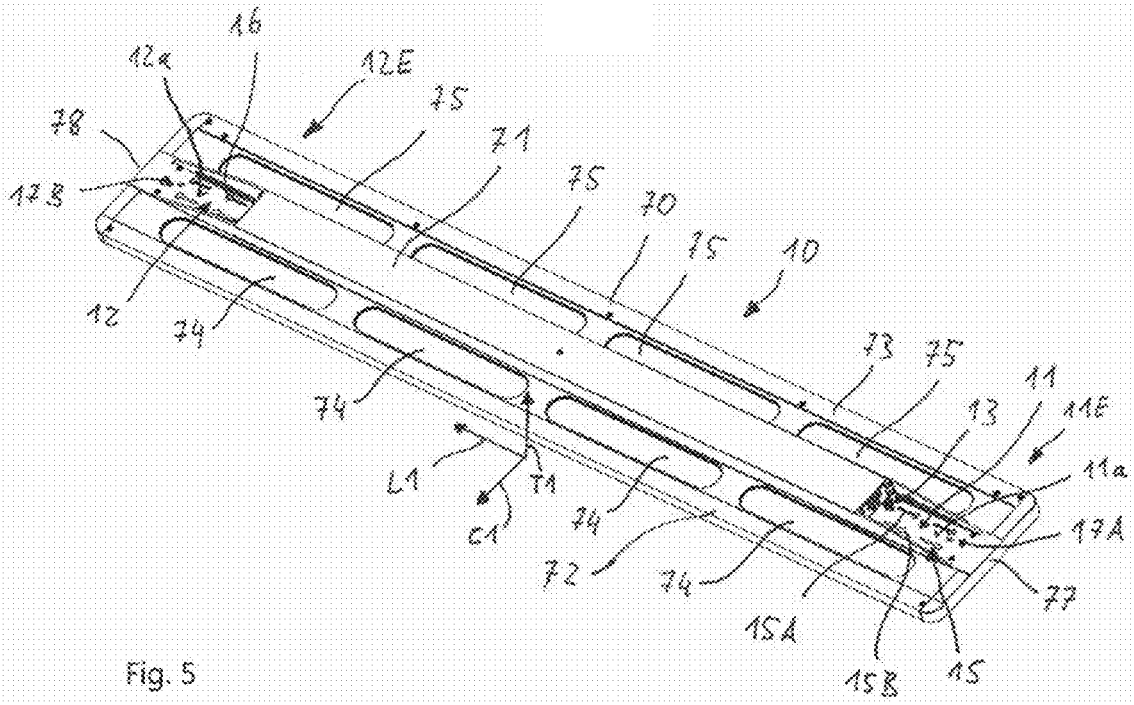
Fig. 5
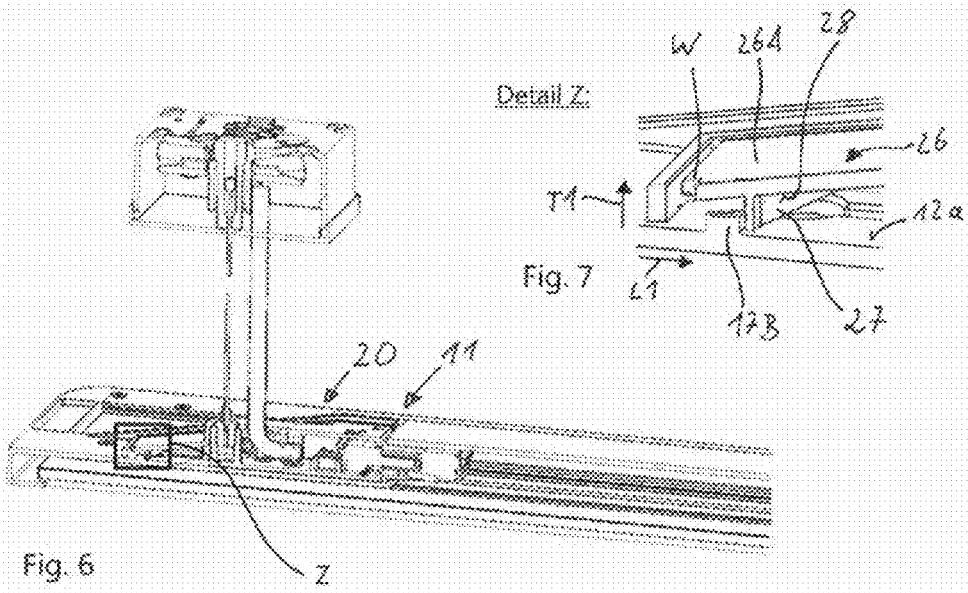
Fig. 7
Fig. 6

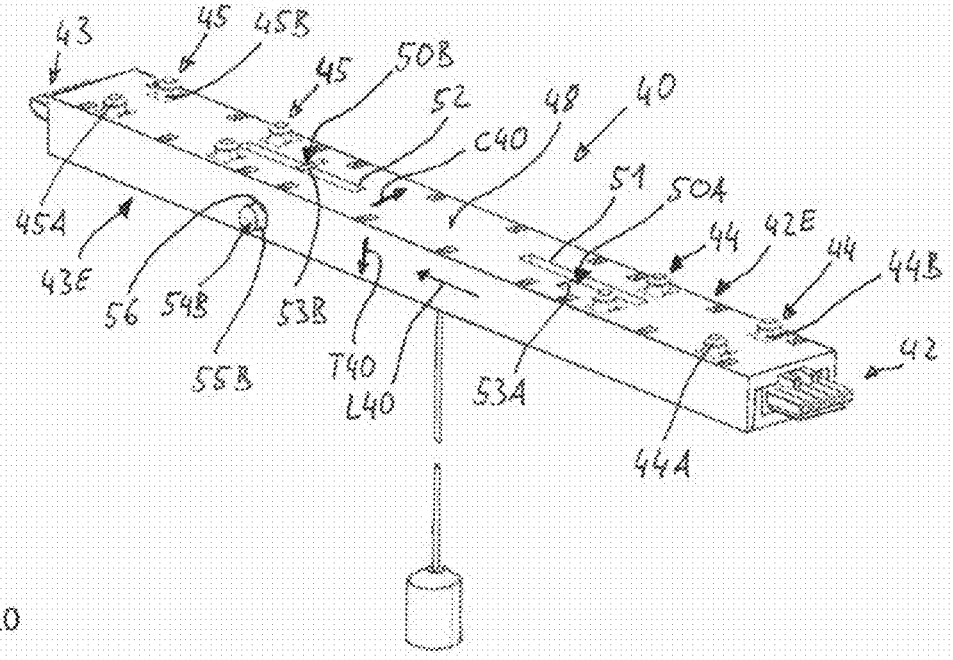
Fig. 10
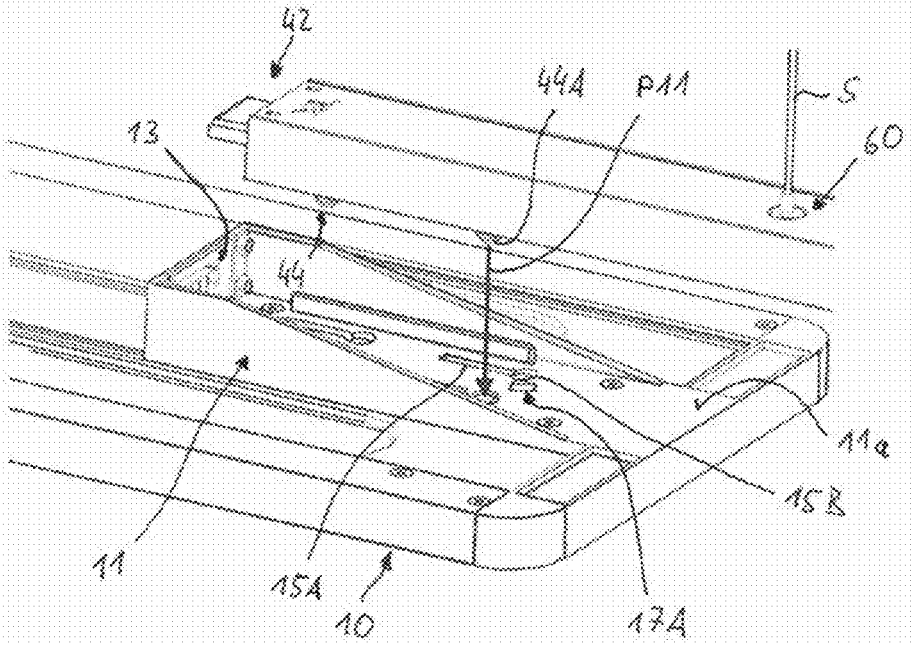
Fig. 11
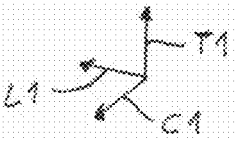

LIGHTING SYSTEM

FIELD OF THE INVENTION

The present invention relates to a lighting system.

BACKGROUND

Lighting systems in which one or more luminaires are fastened to a ceiling of a building by a fastening cord are known from the general prior art. The fastening cord is usually fixed directly to a housing of the luminaire in this case. In these systems, an electrical connection to the luminaire is normally made by the individual terminals being inserted separately into each of the connecting terminals provided on the luminaire.

SUMMARY OF THE INVENTION

According to a first aspect of the invention, a lighting system is provided which comprises at least one luminaire having a connection portion, and comprises a fastening device. Said fastening device comprises: a housing; an electrical contact-making connection, which can be detachably inserted into a supply connection of the luminaire, which supply connection is formed in the connection portion and has the complimentary design to said electrical contact-making connection; at least one retaining pin, which protrudes from the housing and has a securing portion, wherein the retaining pin, in a fitted state of the fastening device with the contact-making connection inserted in the supply connection of the luminaire, extends through a slot formed in the connection portion of the luminaire, and the securing portion of the retaining pin is engaged behind a region of the connection portion that defines the slot; and a fastening portion for fastening a retaining cord and/or for connecting the terminals of an electrical supply cable.

The luminaire may extend in particular along a luminaire longitudinal direction. The connection portion in particular can be formed at an end portion of the luminaire. The luminaire can also comprise, for example, a first connection portion and a second connection portion, which are formed one at each end portion of the luminaire, which end portions are located at opposite ends with reference to the luminaire longitudinal direction.

The securing portion of the retaining pin may engage behind the region of the connection portion that defines the slot, in particular with reference to a luminaire depth direction, which in an installed state of the lighting system, for instance on a building ceiling or on a fixing rail mounted thereon, for example runs along the direction of gravity. In the fitted state of the fastening device, this achieves an interlocking connection of the fastening device to the luminaire with reference to the luminaire depth direction. This interlocking connection by means of a securing portion formed on the retaining pin of the fastening device has the effect that all the components needed for fitting are already formed on the fastening device and need not be detached therefrom for fitting. Thus, for example, there is no need for an additional tool for fitting, and the fastening device can be fitted particularly quickly and easily.

Since in the fitted state of the fastening device the electrical contact-making connection is also in the inserted state in the supply connection of the luminaire, an electrical connection to the luminaire is made at the same time. This has the effect that the luminaire is both fastened mechanically and connected electrically in particular in a single fitting operation for the fastening device. Thus the system can be fitted quickly and easily. Since the electrical connection of the luminaire is made by simply plugging the electrical contact-making connection of the fastening device onto the supply connection of the luminaire, skilled electricians are not needed for fitting. This has the effect that the system can also be fitted by unskilled personnel, for instance even by the user of the lighting system.

The electrical contact-making connection of the fastening device can be embodied as a plug or a socket, for example. The supply connection of the luminaire accordingly has the complimentary design to the electrical contact-making connection of the fastening device.

The fastening portion of the fastening device can be provided solely for fastening a retaining cord or a retaining device, which retaining cord or retaining device is designed purely for holding the fastening device mechanically on a fixing structure. Alternatively or additionally, the fastening portion can be designed for connecting the terminals of an electrical supply cable. For instance, the fastening portion can be intended both for connecting the terminals of an electrical supply cable and for fastening the retaining cord. It is also possible that the supply cable and the retaining cord are embodied as a single component that performs both the retaining function and the electrical contact-making function.

Moreover, it can be provided for the lighting system that the housing of the fastening device comprises a base support comprising a base and two side walls, which face each other and extend from the base perpendicular thereto in a housing depth direction, and comprises a cover, which is joined to the base support and comprises a cover portion that can move along the housing depth direction and is tensioned in the housing depth direction.

The tensioning of the cover portion in the housing depth direction can be achieved, for example, by the cover portion being made of a resiliently deformable material, which for a movement, in particular bending, in a direction oriented away from the base of the base support of the housing, produces a force opposite to the direction of movement. Alternatively, the cover portion can have a hinged connection to another portion of the cover, and a tensioning element, e.g. in the form of a leaf spring, can be provided, which tensions the cover portion in the direction of the base of the base support of the housing.

The base support of the housing can be made, for example, of a metal material such as aluminium, an aluminium alloy or the like, and the cover can be made of a resiliently deformable plastics material. This material combination has the effect that the base support provides the housing with strength and flexural rigidity while the cover, thanks to its elasticity, can be tensioned against the base of the base support without additional components being needed. This results in a particularly simple construction of the fastening device.

The fastening device can also comprise a catch, which is formed on a surface of the cover portion of the housing of the fastening device, which surface faces in an opposite direction to the housing depth direction, and protrudes from said surface of the cover portion, wherein in the fitted state of the fastening device, the catch is engaged behind a catch block formed on a connection surface of the connection portion of the luminaire.

The aforementioned surface of the cover portion may in particular face the base of the base support of the housing of the fastening device. In the fitted state of the fastening device, the surface of the cover portion may also face the connection surface of the connection portion.

In the fitted state of the fastening device, the catch of the cover portion of the fastening device may be engaged behind the catch block of the connection portion in particular with reference to the luminaire longitudinal direction.

The fastening device may be fixed to the luminaire in an interlocking manner by simple means by means of the catch of the cover portion of the housing of the fastening device and the catch block of the connection portion of the luminaire. In particular, the tensioning of the cover portion and the fact that all the components needed for fixing are formed or provided on the fastening device and/or on the luminaire itself result in a particularly simple construction of the system using a minimum number of components.

The above-described lighting system according to the first aspect of the invention can additionally comprise one or more features of the lighting system described below.

A second aspect of the invention relates to a lighting system that comprises at least two luminaires, wherein a connection portion of a first luminaire can be connected to a connection portion of a second luminaire by a connector. The connector comprises in particular: a connector housing; a first electrical contact-making connection and a second electrical contact-making connection, wherein the first and second electrical contact-making connections each have a complimentary design to the supply connection of the corresponding luminaire and can be detachably inserted into said supply connection; at least one first retaining pin and at least one second retaining pin, wherein the first and second retaining pins each protrude from the connector housing and have a securing portion, wherein in a fitted state of the connector with the first and second contact-making connections of the connector each inserted in the respective supply connections of the first and second luminaires, the first retaining pin extends through a slot formed in the connection portion of the first luminaire, and the securing portion of the first retaining pin is engaged behind a region of the connection portion of the first luminaire, which region defines the slot, and the second retaining pin extends through a slot formed in the connection portion of the second luminaire, and the securing portion of the second retaining pin is engaged behind a region of the connection portion of the second luminaire, which region defines the slot.

The at least one first retaining pin of the connector and the at least one second retaining pin of the connector for example have the same design as the retaining pins of the fastening device described above.

The first and second electrical contact-making connections of the connector can both be embodied as plugs or both as sockets, or each have a different embodiment as plug or socket. In particular, the first and second electrical contact-making connection of the connector can each have the same design as the contact-making connection of the fastening device.

The connector can be designed in particular as a linear component, wherein the first electrical contact-making portion is arranged at a first end portion of the connector, and the second electrical contact-making portion is arranged at a second end portion of the connector located opposite the first end portion. In particular, the connector extends along a connector longitudinal direction, and the end portions of the connector are located opposite one another with reference to the connector longitudinal direction. In particular, the connector can be in the form of a component that is straight or is slightly curved in portions, although the connector can also have any other suitable geometrical design.

Alternatively, the connector can also be in the form of an approximately L-shaped or a T-shaped component or a component in the shape of a cross or a star, wherein a first electrical contact-making portion and a second electrical contact-making portion are arranged at least at two free end portions of the connector. The connector can generally have two or more connector arms, which are connected to one another and each run along a connector-arm longitudinal direction. The connector-arm longitudinal directions can run at an angle to one another. For instance, any two connector-arm longitudinal directions can enclose any angle.

The connector arms each extend between the free end portion and a connected end portion, at which at least two connector arms at a time are connected to one another. The individual connector arms can generally be designed as a single part or formed from a plurality of separate parts that are fixed to one another, for example by welding, adhesive bonding, screw-fastening or the like. The free end portions of the various connector arms form the free end portions of the connector.

At each of at least two of the free end portions are arranged the electrical contact-making portions. For example, electrical contact-making connections are arranged at all the free end portions.

Thus it is possible to connect electrically and/or mechanically to one another in particular two luminaires for an L-shaped connector, in particular three luminaires for a T-shaped connector, in particular four luminaires for a cross-shaped connector, and more than four luminaires for a star-shaped connector.

The L-shaped, T-shaped or cross-shaped design for example allows the lighting system to be adapted to suit the lighting requirements and the structural layout of a room in which the lighting system is meant to be installed.

In the fitted state of the connector, the electrical contact-making connections are in the state in which they are plugged into or connected to the supply connections of the first and second luminaires respectively. At the same time, as a result of the securing portions engaging behind the regions of the connection portions of the first and second luminaires, which regions define the slots, the connector is fixed thereto in an interlocking manner. Thus a simultaneous electrical and mechanical connection is made to the luminaires. This has the effect in particular that both a mechanical connection and an electrical connection of the first and second luminaires is made in a single fitting operation for the connector. The system can thereby be fitted quickly and easily. Since the luminaire is electrically connected simply by plugging the electrical contact-making connection of the fastening device onto the supply connection of the luminaire, fitting does not require skilled electricians.

In particular, the connector housing can comprise a base support comprising a base and two side walls, which face each other and extend from the base perpendicular thereto in a housing depth direction, and can comprise a cover piece, wherein said cover piece is joined to the base support.

This results in a profile of the base support that is approximately U-shaped in cross section. This has the effect that the base support has high flexural rigidity. It is thereby possible for the first and second luminaires to be connected, for example, solely at their opposite end portions to a fixing structure, for instance by a retaining cord which is fixed to fastening devices that are fitted at connection portions of the first and second luminaires, which connection portions are formed at the end portions.

In general, the luminaires can span long distances by means of the connector. One reason is that, by virtue of the first and second retaining pins of the connector and the first and second electrical contact-making connections of the connector, said connector facilitates a modular design of the lighting system in which any number of luminaires, even luminaires of different lengths, can be combined with one another. Another reason is that the optional U-shaped cross-sectional profile of the base support of the connector housing allows the individual luminaires to have a long length.

The base support of the connector housing can be made in particular of a metal material. The cover of the connector housing is for example made of a resiliently deformable plastics material, but can also be made of another material. A material based on aluminium in particular is suitable as the metal material. This has the effect that a high rigidity of the housing can be achieved for low weight.

It can also be provided for example that the connector comprises a first securing device and a second securing device, both of which are arranged inside the connector housing and are assigned to a first slot and a second slot respectively formed in the base of the base support of the connector housing, wherein the first and second securing devices each comprise a securing latch that can move transverse to the longitudinal extent of the corresponding slot between a securing position, in which said securing latch protrudes into the corresponding slot, and a release position, in which said securing latch detaches from the slot, wherein in the fitted state of the connector, the securing latch of the first securing device is engaged in its securing position behind the catch block of the connection portion of the first luminaire, and the securing latch of the second securing device is engaged in its securing position behind the catch block of the connection portion of the second luminaire.

The first and second securing devices can each comprise a sliding actuator, which is connected to the corresponding securing latch.

It can also be provided that the first and second securing devices each comprise a tensioning means, which tensions the corresponding securing latch transverse to the longitudinal extent of the corresponding slot of the connector housing when said securing latch is in its securing position.

The connector can also comprise a fastening portion for fastening a retaining cord and/or for connecting the terminals of an electrical supply cable. The fastening portion of the connector can have a similar design to the fastening portion of the fastening device.

The features disclosed for the lighting system according to the first aspect of the invention can also be implemented for the lighting system according to the second aspect of the invention. Similarly, the features disclosed for the lighting system according to the second aspect of the invention can also be implemented for the lighting system according to the first aspect of the invention.

BRIEF DESCRIPTION OF THE DRAWINGS

Embodiments of the invention are described in greater detail below and depicted in the figures of the drawing, in which:

FIG. 5 is a perspective view of a luminaire of the lighting system according to an embodiment of the present invention;

FIG. 6 is a sectional view of a lighting system according to an embodiment of the present invention in a state of the fastening device shown in FIG. 2 in which it is fitted on the luminaire shown in FIG. 5;

FIG. 7 is a detail of the region labelled with the letter Z in FIG. 6;

FIG. 10 is a perspective view of the connector shown in FIGS. 8 and 9 viewed at an oblique angle from below onto a base support of the connector housing;

FIG. 11 is a perspective view of the lighting system shown in FIG. 8, which view shows the lighting system in a state in which the connector is not fitted;

DETAILED DESCRIPTION OF EMBODIMENTS

Figure 1:
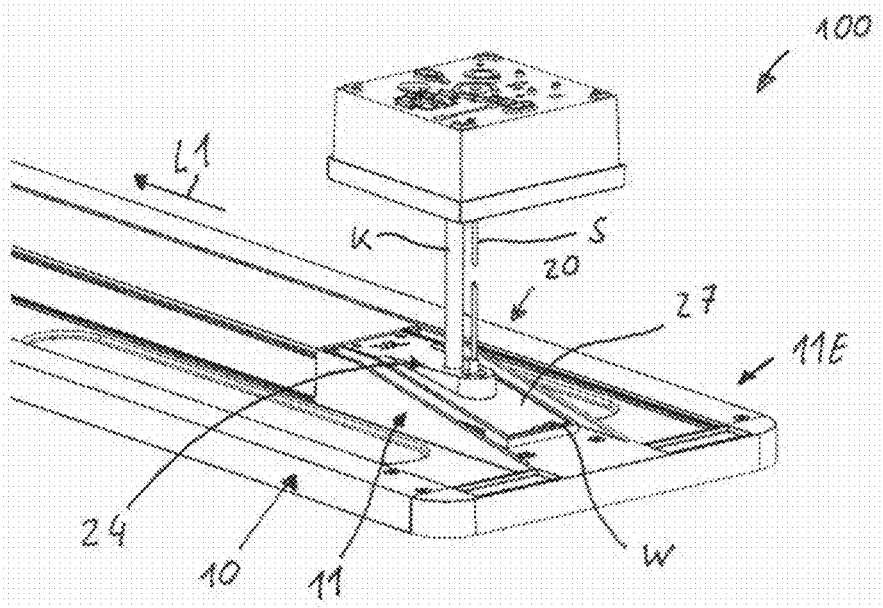
FIG. 1 is a perspective view of a lighting system according to an embodiment of the present invention.

FIG. 1 shows a basic variant of a lighting system 100 according to an embodiment of the present invention. As shown in FIG. 1, the lighting system 100 comprises at least one luminaire 10 and a fastening device 20.

In particular, the luminaire 10 can be in the form of a linear luminaire 10 extending in a luminaire longitudinal direction L1. The luminaire 10 comprises at least one connection portion 11, which is located at a first end portion 11E of the luminaire 10. The luminaire 10 can also comprise a second connection portion 12, which is arranged at a second end portion 12E of the luminaire 10 that is located opposite the first end portion 11E with reference to the luminaire longitudinal direction L1.

As is shown by way of example in FIG. 5, the luminaire 10 can comprise a profiled support 70 which extends in the luminaire longitudinal direction L1 and comprises a central portion 71 having a U-shaped cross section and side panels 72, 73 that extend on each side from the central portion 71 in a luminaire transverse direction C1. In each of the side panels 72, 73 can be formed linear lighting apertures 74, 75, through which can be emitted light generated by a light source (not shown). The light that can be emitted through the linear lighting apertures 74, 75 can be intended for illuminating a ceiling of a room. As FIG. 5 also shows, the luminaire 10 can additionally comprise a first and a second end piece 77, 78, said first end piece 77 being connected to the profiled support 70 at the first end portion 11E of the luminaire 10, and said second end piece 78 being connected to the profiled support 70 at the second end portion 12E of the luminaire 10. For example, the connection portion 11 can be formed at the first end piece 77, and the second connection portion 12 can be formed at the second end piece 78.

The profiled support 70 is for example in the form of a drawn aluminum section. The end pieces 77, 78 can likewise be made of an aluminum material.

The connection portions 11, 12 each comprise a supply connection 13. The supply connection 13 can comprise electrical connection components for connecting the light source of the luminaire to an electrical power supply. The supply connection 13 can be embodied as a socket, as shown by way of example in FIG. 5. Alternatively, the supply connection 13 can also be embodied as a plug. If two connection portions 11, 12 are provided on one luminaire, as is shown by way of example in FIG. 5, both of the supply connections 13 can be in the form of a socket or both in the form of a plug. Alternatively, one of the supply connections 13 can be in the form of a plug and the other supply connection can be in the form of a socket.

In the connection portion 11 and, if applicable, in the second connection portion 12, is formed in each case at least one slot 15, 16, which extends along the luminaire longitudinal direction L1. The slot 15, 16 has a linear portion 15A and an insertion portion 15B. For reasons of clarity, these portions are shown solely for one of the slots 15 formed in the connection portion 11. The linear portion 15A has a smaller width than the insertion portion 15B with reference to the luminaire transverse direction C1. The insertion portion 15B can be embodied, for example, as a circular hole of width equal, in this case, to the diameter of the hole and large enough to allow a securing portion 23A, 33A (described in detail below) of a retaining pin 23, 33 of a fastening device 20, 30, or a securing portion 44A, 45A of a retaining pin 44, 45 of a connector 40, to be inserted into the insertion portion 15B.

Figure 2:
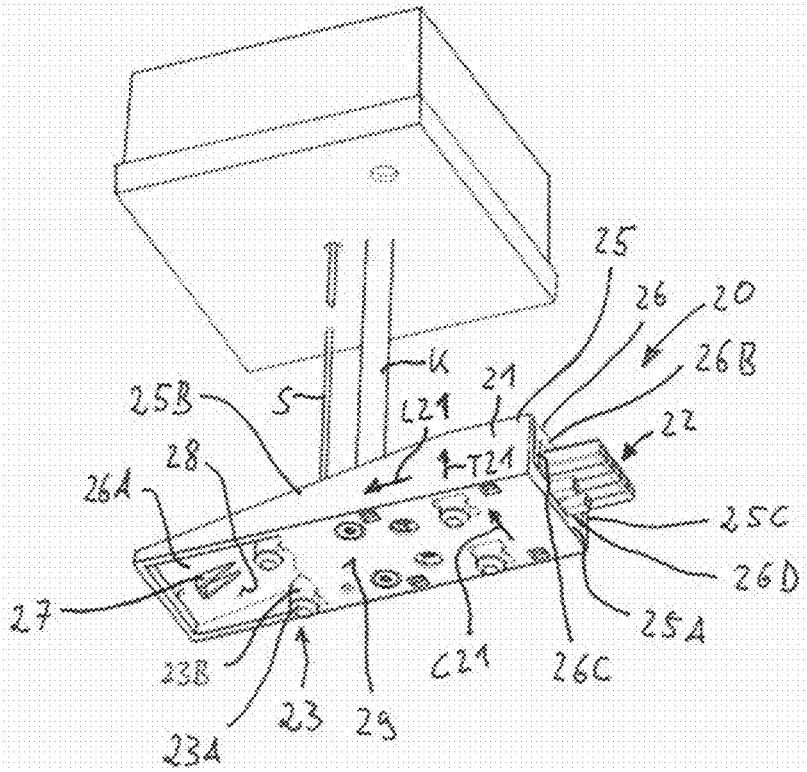
FIG. 2 is a perspective view of a fastening device of the lighting system according to the embodiment shown in FIG. 1.
Figure 4:
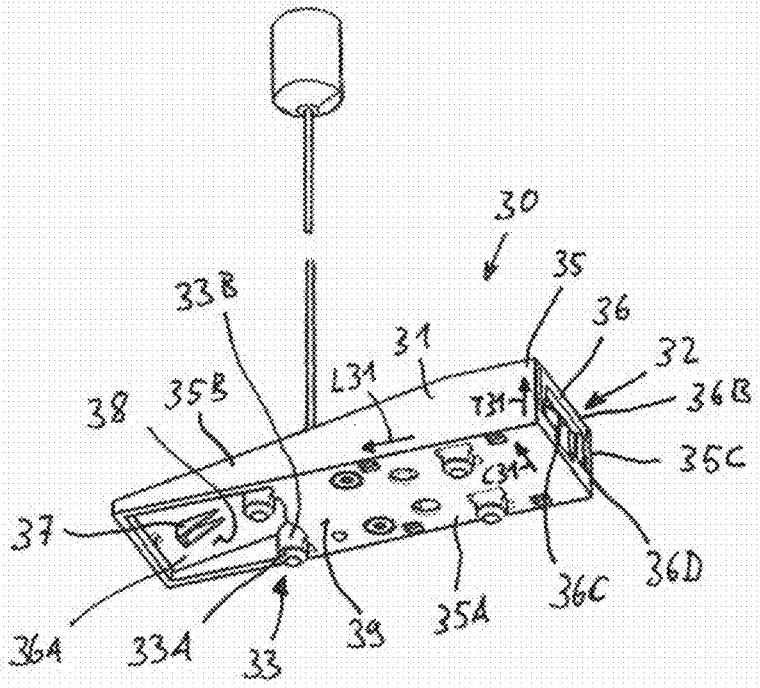
FIG. 4 is a perspective view of a fastening device of the lighting system according to the embodiment shown in FIG. 3.

FIGS. 2 and 4 each show a fastening device 20, 30, where the fastening device 30 shown in FIG. 4 and the fastening device shown in FIG. 2 differ in particular in terms of a fastening portion 24, 34. The fastening devices 20 and 30 are described jointly below.

The lighting system 100 comprises at least one of the fastening devices 20, 30. The fastening device 20, 30 comprises a housing 21, 31, an electrical contact-making connection 22, 32 and at least one retaining pin 23, 33.

The housing 21, 31 of the fastening device 20, 30 can comprise in particular a base support 25, 35 and a cover 26, 36, as shown by way of example in FIGS. 1 to 6.

The base support 25, 26 of the housing 21, 31 of the fastening device 20, 30 comprises a base 25A, 35A and two side walls 25B, 25C, 35B, 35C, which face each other and extend from the base 25A, 35A perpendicular thereto in a housing depth direction T21, T31.

The cover 26, 36 of the housing 21, 31 of the fastening device 20, 30 in particular comprises a cover portion 26A, 36A. In addition, the cover can comprise a cap portion 26B, 36B joined to the cover portion 26A, 36A, from which cap portion extend opposite cover side walls 26C, 26D, 36C, 36D along the housing depth direction T21, T31.

The cover 26, 36 is joined to the base support 25, 35 and fixed thereto, for example in an interlocking manner by means of a clip connection or frictionally connected or integrally bonded thereto.

The cover portion 26A, 36A of the cover 26, 36 is designed to be able to move along the housing depth direction T21, T31 and is tensioned in the housing depth direction T21, T31.

The tensioning can be achieved, for example, by the elasticity of the material of which the cover portion 26A, 36A is made.

The base support 25, 35 can be made of a metal material, in particular of an aluminum material, and the cover 26, 36 can be made of a resiliently deformable plastics material.

The side walls 25B, 25C, 35B, 35C and the base 25A, 35A of the base support 25, 35 can for example be formed as one piece. The cover portion 26A, 36A, the cap portion 26B, 36B and the cover side walls 26C, 26D, 36C 36D of the cover 26, 36 can likewise be formed as a single piece.

The electrical contact-making connection 22, 32 of the fastening device 20, 30 has the complimentary design to the supply connection 13 of the luminaire 10, i.e. is in the form of a socket or a plug. For the fastening device 20 shown by way of example in FIG. 2, the contact-making connection 22 is in the form of a plug. For the fastening device 30 shown by way of example in FIG. 4, the contact-making connection 32 is in the form of a socket. The contact-making connection 22, 32 can be detachably inserted into, or connected to, the supply connection 13 of the luminaire 10.

Figure 3:
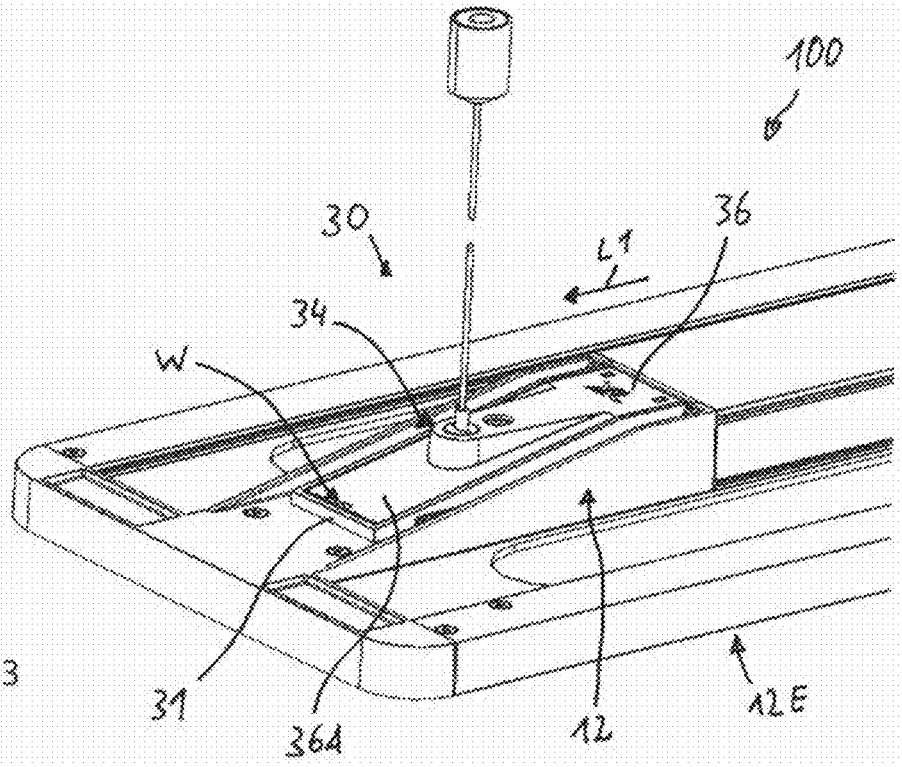
FIG. 3 is a perspective view of the lighting system according to another embodiment of the present invention.

FIGS. 1, 3 and 6 each show by way of example a fitted state of the fastening device 20, 30 with the contact-making connection 22, 32 inserted in, and/or connected to, the supply connection 13 of the luminaire.

The fastening device 20, 30 comprises at least one retaining pin 23, 33. This pin protrudes from the housing 21, 31. In particular, the retaining pin 23, 33 protrudes above a guide surface 29, 39 of the housing 21, 31 of the fastening device 20, 30 with reference to the housing depth direction T21, T31. The guide surface 29, 39 is provided on the base 25A, 35A of the base support 25, 35 of the housing 21, 31. The fastening devices 20, 30 shown by way of example in FIGS. 2 and 4 each comprise four retaining pins 23, 33. There can also be just one retaining pin 23, 33, however.

The retaining pins 23, 33 each have a securing portion 23A, 33A. This forms an end portion of the retaining pin 23, 33, which end portion is opposite the guide surface 29, 39. The retaining pins 23, 33 also each have a main portion 23B, 33B, which joins the securing portion 23A, 33A to the housing 21, 31 or to a component arranged inside the housing 21, 31.

The main portion 23B, 33B of the retaining pin 23, 33 can be designed, for example, to have a circular, elliptical, rectangular or polygonal cross section.

The securing portion 23A, 33A of the retaining pin 23, 33 for example has a circular cross section, but can also be designed to have an elliptical, rectangular or polygonal cross section. The retaining portion 23A, 33A protrudes with respect to the main portion 23B, 33B of the retaining pin 23, 33 with reference to a housing transverse direction C21, C31 running perpendicular to the housing depth direction T21, T31, as shown in FIGS. 2 and 4.

FIGS. 1 and 3 each show the fastening device 20, 30 in the state in which it is fitted on the luminaire 10. In the fitted state, the retaining pin 23, 33 extends through the slot 15, 16 formed in the corresponding connection portion 11, 12 of the luminaire 10. In particular, the main portion 23B, 33B extends through the linear portion 15A of the slot 15, 16. The securing portion 23A, 33A of the retaining pin 23, 33 is arranged, with reference to the luminaire transverse direction C1, lateral to the linear portion 15A of the slot 15, 16 and thus is engaged, with reference to a luminaire depth direction T1, behind a region of the connection portion 11, 12 that defines the slot 15, 16, which luminaire depth direction T1 runs perpendicular to the luminaire transverse direction C1 and the luminaire longitudinal direction L1.

This achieves an interlocking connection between the fastening device 20, 30 and the luminaire 10, in particular with reference to the luminaire depth direction T1.

In order to fit the fastening device 20, 30 to the luminaire 10, the fastening device 20, 30 is first inserted by the retaining pins 23, 33 into the slot 15, 16 in a direction opposite to the luminaire depth direction T1, in particular inserted into the insertion portion 15B of the slot 15, 16. Then the fastening device 20, 30 is pushed along the luminaire longitudinal direction L1. The contact-making connection 22, 32 of the fastening device 20, 30 is thereby inserted into, and/or connected to, the supply connection 13 of the luminaire 10, and the retaining pin 23, 33 is positioned in the linear portion 15A of the slot 15, 16 of the connection portion 11, 12 of the luminaire 10. While the fastening device 20, 30 is being pushed along the luminaire longitudinal direction L1 and when in the fitted state, the fastening device 20, 30 for example rests by the guide surface 29, 39 of the housing 21, 31 on a connection surface 11*a*, 12*a* of the connection portion 11, 12.

The fastening device 20, 30 also comprises a fastening portion 24, 34. As is the case for the fastening device 30, the fastening portion can be designed for fastening a retaining cord S, which can be used to connect the fastening device 30 to a fixing structure such as a building ceiling or a fixing rail, for example. Alternatively or additionally, the fastening portion 24, 34 can be designed for connecting the terminals of an electrical supply cable K. The fastening device 20 shown in FIGS. 1 and 2 is designed by way of example both for connecting the terminals of an electrical supply cable K and for fastening the retaining cord S. It is also possible that the supply cable K and the retaining cord S are embodied as a single component that performs both the retaining function and the function of making electrical contact.

The fastening device 20, 30 can also comprise a catch 27, 37 for the purpose of fixing the fastening device 20, 30 on the connection portion 11, 12 in an interlocking manner with reference to the luminaire longitudinal direction L1. FIGS. 6 and 7 show by way of example a corresponding fixing of the fastening device 20 to the optional connection portion 12. The fastening device 20 can be fixed in an identical manner to the connection portion 11, and the fastening device 30 can be fixed in an identical manner to the connection portion 11 or to the second connection portion 12.

The catch 27, 37 of the fastening device 20, 30 is formed on a surface 28, 38 of the cover portion 26A, 36A of the housing 21, 31 of the fastening device 20, 30 and protrudes from said surface 28, 38, which faces in an opposite direction to the housing depth direction T21, T31. As shown in FIGS. 2 and 4, the catch 27, 37 can have, for example, a U-shaped design with a cross-member along the housing transverse direction C21, C31 and two longitudinal members, which face each other and run along a housing longitudinal direction L21, L31.

The housing longitudinal direction L21, L31 runs perpendicular to the housing transverse direction C21, C31 and to the housing depth direction T21, T31. The longitudinal members of the catch 27, 37 in particular can be designed to have an inclined surface, as is shown by way of example in FIGS. 2 and 4.

In the fitted state of the fastening device 20, 30, the catch 27, 37 is engaged behind a catch block 17A, 17B formed on a connection surface 11*a*, 12*a* of the connection portion 11, 12 of the luminaire 10. This fitted state is shown by way of example in the detail in FIG. 7. The catch block 17A, 17B in particular protrudes above the connection surface 11*a*, 12*a* of the connection portion 11, 12 with reference to the luminaire depth direction T1. In addition, for example, the catch block 17A, 17B can have a triangular shape viewed from above in a direction opposite the luminaire depth direction T1.

For the purpose of removal, the cover portion 26A of the cover 26 is resiliently deformed such that it is raised in the luminaire depth direction T1, in particular is raised so far that the catch 27, 37 is positioned above the catch block 17A, 17B with reference to the luminaire depth direction T1. In this state, the interlocking fixation of the fastening device 20, 30 is released with reference to the luminaire longitudinal direction L1, and the fastening device can be moved in the luminaire longitudinal direction L1 and/or opposite thereto.

The cover portion 26A, 36A can for example comprise a tool insertion point W. This may be formed as a cutout, for example, as shown in FIGS. 1, 3 and 7. A tool for resilient deformation of the cover portion 26A, 36A can be inserted at the tool insertion point W. For instance, a screwdriver can be inserted into a tool insertion point W in the form of a cutout and twisted such that a force directed in the housing depth direction T21, T31 is exerted on the cover portion 26A, 36A, as a result of which, the cover portion 26A, 36A is deformed and/or raised.

According to the present invention, a lighting system 100 can also be provided, which comprises a plurality of luminaires 10, in particular at least two luminaires 10A, 10B. The luminaires 10A, 10B in this case for example have the same design as the luminaire 10 already described.

Figure 8:
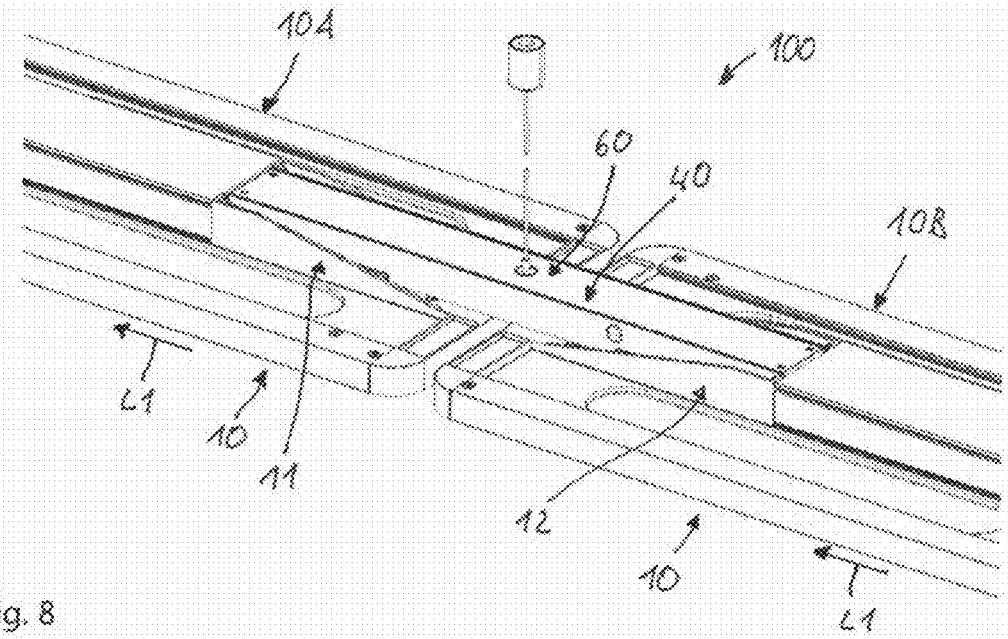
FIG. 8 is a perspective view of a lighting system according to another embodiment of the present invention comprising a connector, which view shows the lighting system in a fitted state of the connector.

FIG. 8 shows by way of example a lighting system 100, which comprises at least two luminaires 10A, 10B. In this system, a connection portion 11 of a first luminaire 10A is connected by a connector 40 to a connection portion 12 of a second luminaire 10B. The connector 40 connects the luminaires 10A, 10B both electrically and mechanically.

Figure 9:
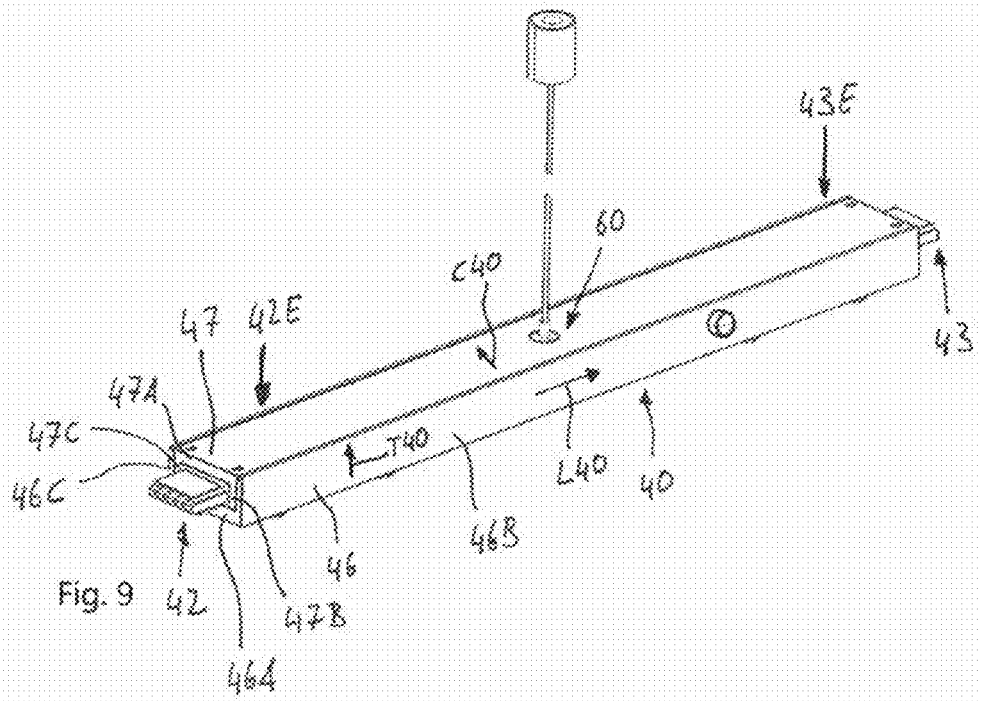
FIG. 9 is a perspective view of the connector of the lighting system shown in FIG. 8 viewed at an oblique angle from above onto a cover of a connector housing.

As shown in FIGS. 9 and 10, the connector 40 comprises a connector housing 41, at least one first electrical contact-making connection 42, at least one second electrical contact-making connection 43, at least one first retaining pin 44 and at least one second retaining pin 45.

As shown by way of example in FIGS. 9 and 10, the connector 40 can be designed as a linear component that extends along a connector longitudinal direction L40. The connector 40 can also be embodied as an L-shaped component, as shown by way of example in FIG. 14, or as a T-shaped component, as shown by way of example in FIG. 15, or as a component shaped as a cross, as shown by way of example in FIG. 16, or have any other suitable geometrical design.

The connector housing 41 can comprise a base support 46 having a base 46A, which extends in the connector longitudinal direction L40, and two side walls 46B, 46C, which face each other and extend from the base 46A perpendicular thereto in a connector depth direction T40. The base 46A and the side walls 46B, 46C thereby define a U-shaped cross section of the base support 46 of the connector housing 41. This has the effect that the connector housing 41 hence has high flexural rigidity with respect to bending transverse to the connector longitudinal direction L40.

The connector housing 41 can also comprise a cover piece 47, which is joined to the base support 46, for instance by a clip connection, by screw-fastening, riveting, adhesive bonding or the like. The cover piece 47 can comprise a cap 47A, which extends in the connector longitudinal direction L40 and comprises two side walls 47B, 47C, which face each other and extend from the cap 47A perpendicular thereto along the connector depth direction T40. The cap 47A of the cover piece 47 of the connector housing 41 is for example arranged opposite the base 46A of the base support 46 such that the side walls 47B, 47C of the cover piece 47 run along the side walls 46B, 46C of the base support 46, with the result that the cover piece 47 and the base support 46 define an interior of the connector housing 41. In particular, electrical functional components, for example components such as electrical leads, resistors and the like, can be arranged in the interior.

The base support 46 of the connector housing 41 can be made of a metal material, for example a material based on aluminium, and the cover 47 of the connector housing 41 can be made of a resiliently deformable plastics material, for example a thermoplastic plastics material.

The first electrical contact-making connection 42 of the connector 40 can be detachably inserted into, and/or connected to, the supply connection 13 of the first luminaire 10A. The first contact-making connection 42 accordingly has the complimentary form to the supply connection 13 of the first luminaire 10A, for instance is in the form of a plug or a socket. The second electrical contact-making connection 43 has a complimentary form to the supply connection of the second luminaire 10B, for instance is in the form of a plug or a socket, and can be detachably inserted into said supply connection. For the connectors 40 shown in FIGS. 8 and 9, the first and second electrical contact-making connections 42, 43 are both in the form of plugs. It can also be provided, however, that one of the contact-making connections 42, 43 of the connector 40 is in the form of a plug, and the other contact-making connection 43, 42 is in the form of a socket, or both contact-making connections 42, 43 are in the form of a socket.

The first contact-making connection 42 of the connector 40 can be arranged at a first end portion 42E of the connector 40, as shown in FIG. 9. The second contact-making connection 43 of the connector 40 is for example arranged at a second end portion 43E of the connector 40, which is located at opposite the first end portion 42E.

Figure 14:
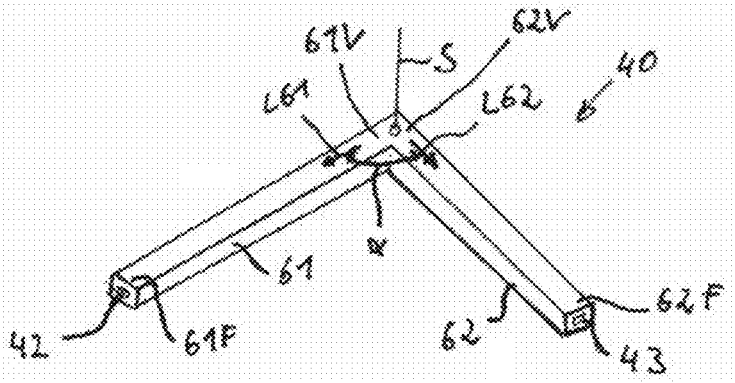
FIG. 14 is a perspective view of an embodiment of a connector for the lighting system shown in FIG. 8.
Figure 15:
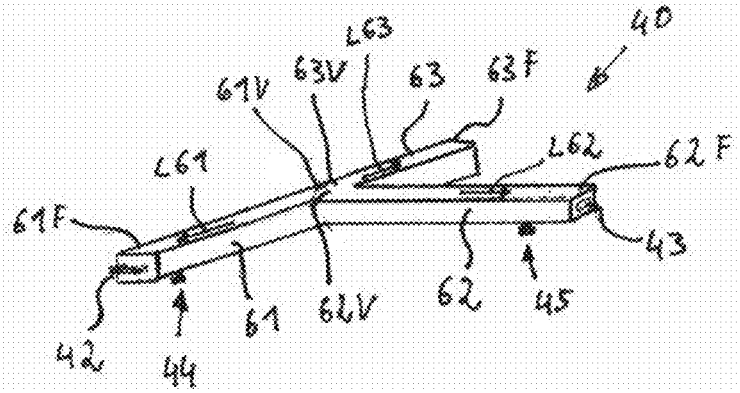
FIG. 15 is a perspective view of another embodiment of a connector for the lighting system shown in FIG. 8.
Figure 16:
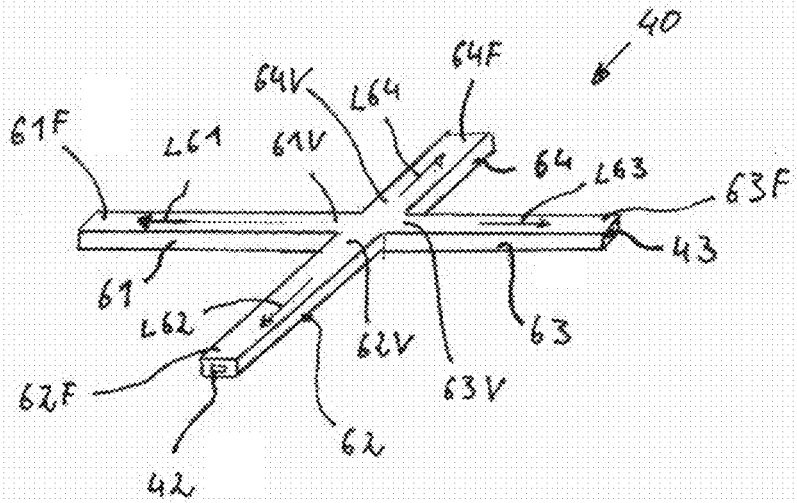
FIG. 16 is a perspective view of another embodiment of a connector for the lighting system shown in FIG. 8.

As already described and as shown in FIGS. 14 to 16, the connector 40 can also be designed as an L-shaped or a T-shaped component or as a component shaped as a cross, with a first and a second electrical contact-making connection 42, 43 being arranged at least at two free end portions 61F, 62F, 63F, 64F of the connector.

In this case, the connector 40 can generally have two or more connector arms 61, 62, 63, 64, which are connected to one another and each run along a connector-arm longitudinal direction L61, L62, L63, L64. The connector-arm longitudinal directions L61, L62, L63, L64 can run at an angle to one another. For instance, any two connector-arm longitudinal directions L61, L62, L63, L64 can enclose any angle $\alpha$.

The connector arms 61, 62, 63, 64 each extend between a free end portion 61F, 62F, 63F, 64F and a connected end portion 61V, 62V, 63V, 64V, at which at least two connector arms 61, 62, 63, 64 at a time are connected to one another. The free end portions 61F, 62F, 63F, 64F of the corresponding connector arms 61, 62, 63, 64 form the free end portions 61F, 62F, 63F, 64F of the connector 40.

The electrical contact-making portions 42, 43 are arranged at each of at least two of the free end portions 61F, 62F, 63F, 64F. For example for the connectors 40 shown in FIGS. 15 and 16, electrical contact-making connections 42, 43 are arranged at all three end portions 61F, 62F, 63F or respectively all four free end portions 61F, 62F, 63F, 64F.

Adding another connector arm to the connector 40 shown in FIG. 16 would produce a star-shaped connector.

The connector 40 also comprises at least one first retaining pin 44 and at least one second retaining pin 45. For the connector 40 shown by way of example in FIG. 10, four first retaining pins 44 and four second retaining pins 45 are provided. There can also be just one first and one second retaining pin 44, 45, however.

The first and second retaining pins 44, 45 of the connector 40 in particular can have an identical design to the retaining pins 23, 33 of the fastening device 20, 30 comprising a securing portion 44A, 45A and a main portion 44B, 45B.

The first and second retaining pins 44, 45 each protrude from the connector housing 41. In particular, the first and second retaining pins 44, 45 protrude above a guide surface 48 of the connector 40 with reference to the connector depth direction T40. The guide surface 48 is provided on the base 46A of the base support 46 of the connector housing 41.

FIG. 8 shows a fitted state of the connector 40 with the first contact-making connection 42 of the connector 40 inserted in, and/or connected to, the supply connections 13 of the first luminaire 10A, and the second contact-making connection 42 of the connector 40 inserted in, and/or connected to, the supply connections of the second luminaire 10B.

In the fitted state of the connector 40, the first retaining pin 44, in particular the main portion 44B thereof, extends through the slot 15 formed in the connection portion 11 of the first luminaire 10A, and the securing portion 44A of the first retaining pin 44 is engaged, with reference to the luminaire depth direction T1, behind the region of the connection portion 11 of the first luminaire 10A, which region defines the slot 15. In particular, the securing portion 44A of the first retaining pin 44 of the connector 40 is arranged, with reference to the luminaire transverse direction C1, lateral to the linear portion 15A of the slot 15 of the connection portion 11 of the first luminaire 10A. This achieves an interlocking connection between the connector 40 and the first luminaire 10A, in particular with reference to the luminaire depth direction T1.

In the fitted state of the connector 40, in addition the second retaining pin 45, in particular the main portion 45B thereof, extends through the slot 16 formed in the connection portion 12 of the second luminaire 10B, and the securing portion 45A of the second retaining pin 45 is engaged, with reference to the luminaire depth direction T1, behind the region of the connection portion 12 of the second luminaire 10B, which region defines the slot 16. In particular, the securing portion 45A of the second retaining pin 45 of the connector 40 is arranged, with reference to the luminaire transverse direction C1, lateral to the linear portion of the slot 16 of the connection portion 12 of the second luminaire 10B. This achieves an interlocking connection between the connector 40 and the second luminaire 10B, in particular with reference to the luminaire depth direction T1.

Figure 12:
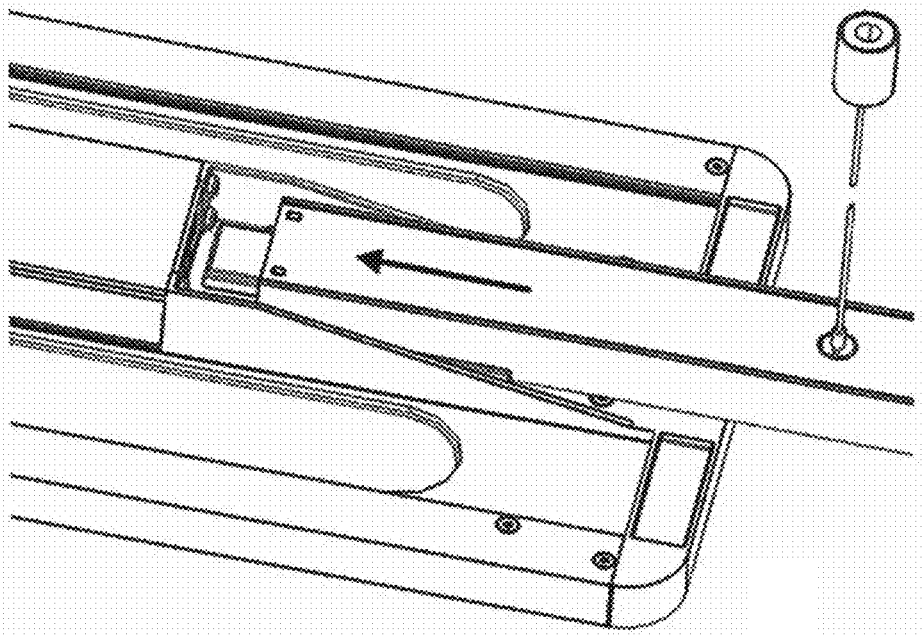
FIG. 12 is a perspective view of the lighting system shown in FIG. 8, which view shows the lighting system in a state prior to fitting the connector.

FIGS. 11 and 12 show by way of example the fitting operation for the connector 40 to the first luminaire 10A. The connector 40 is first inserted by the first retaining pins 44 into the slot 15 in a direction opposite to the luminaire depth direction T1, in particular inserted into the insertion portion 15B of the slot 15, as indicated by the arrow P11 in FIG. 11. Then the connector 40 is pushed along the luminaire longitudinal direction L1, as indicated by the arrow P12 in FIG. 12. The contact-making connection 42 of the connector 40 is thereby inserted into, and/or connected to, the supply connection 13 of the first luminaire 10A, and the first retaining pin 44 is positioned in the linear portion 15A of the slot 15 of the connection portion 11 of the first luminaire 10A. While the connector 40 is being pushed along the luminaire longitudinal direction L1 and when in the fitted state, the connector 40 for example rests by a portion of the guide surface 48 on the connection surface 11*a*, 12*a*, which portion overlaps the connection surface 11*a* of the connection portion 11 of the first luminaire 10A.

The connector 40 can also comprise a first securing device 50A and a second securing device 50B, both of which are arranged inside the connector housing 41.

In the connector housing 41, in particular in the base 46A of the base support 46 of the connector housing 41, are formed a first slot 51, which is arranged in the region of the first end portion 42E of the connector, and a second slot 52, which is arranged in the region of the second end portion 43E of the connector. The first slot and the second slot 51, 52 each extend along the connector longitudinal direction L40 and in particular can each be arranged, with reference to this direction, between the first retaining pin and the second retaining pin 44, 45. With reference to a connector transverse direction C40 running perpendicular to the connector longitudinal direction L40, the slots 51, 52 each have a width that is greater than or equal to the maximum width of the catch block 17A, 17B of the corresponding connection portion 11, 12 with reference to the luminaire transverse direction C1, with the result that the particular catch block 17A, 17B can be positioned in the corresponding slot 51, 52.

The first securing device 50A is assigned to the first slot 51, and the second securing device 50B is assigned to the second slot 52.

Figure 13:
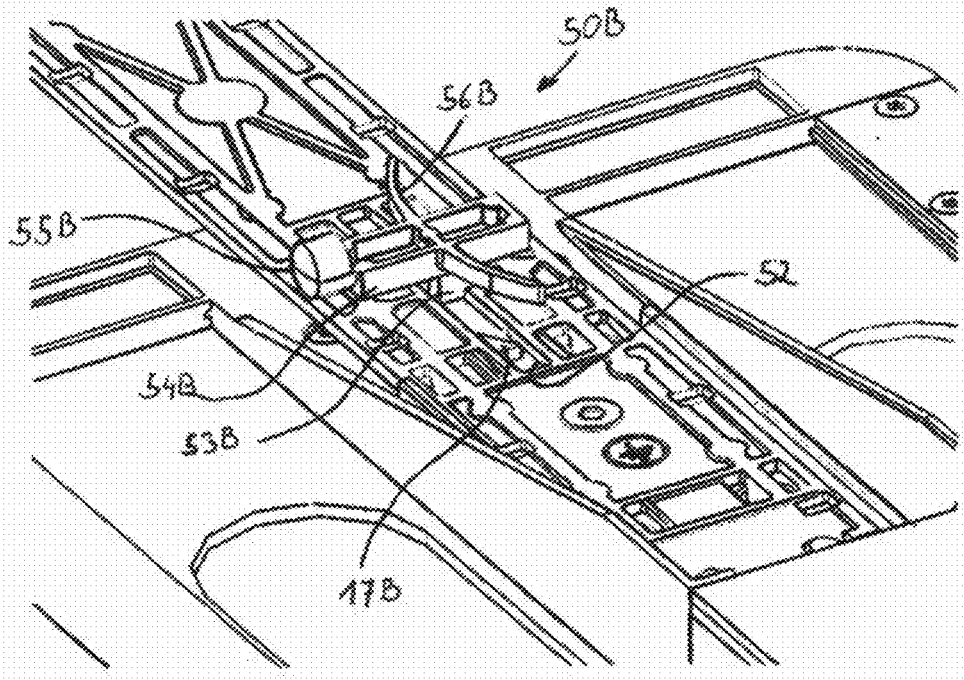
FIG. 13 is a perspective view of the lighting system shown in FIG. 8, which view shows the lighting system in the state shown in FIG. 12 prior to fitting the connector and shows a cutout view of the connector housing.

The first and second securing devices 50A, 50B each comprise a securing latch 53A, 53B, as shown in FIGS. 10 and 13. The securing latches 53A, 53B can move transverse to the longitudinal extent of the corresponding slot 51, 52 between a securing position and a release position, in particular can move in a connector transverse direction C40, which runs perpendicular to the connector longitudinal direction L40.

FIG. 10 shows the securing latch 53B of the second securing device 50B in the securing position, and the securing latch 53A of the first securing device 50A in the release position. In the securing position, the particular securing latch 53A, 53B protrudes into the corresponding slot 51, 52 with reference to the connector transverse direction C40. In the release position, the particular securing latch 53A, 53B detaches from the corresponding slot 51, 52. Thus in the release position, the securing latch 53A, 53B does not protrude into the corresponding slot 51, 52 with reference to the connector transverse direction C40.

In the fitted state of the connector, the securing latch 53A of the first securing device 50A, in its securing position is engaged behind the catch block 17A of the connection portion 11 of the first luminaire 10A, in particular with reference to the luminaire longitudinal direction L1. This achieves an interlocking connection between the first luminaire 10A and the connector 40, in particular with reference to the luminaire longitudinal direction L1.

In addition, in the fitted state of the connector, the securing latch 53B of the second securing device 50B, in its securing position is engaged behind the catch block 17B of the connection portion 12 of the second luminaire 10B, in particular with reference to the luminaire longitudinal direction L1. This achieves an interlocking connection between the second luminaire 10B and the connector 40, in particular with reference to the luminaire longitudinal direction L1.

For removal, the particular securing latch 53A, 53B can be moved into its release position. In this position, the particular securing latch 53A, 53B is positioned to the side of the corresponding latch block 17A, 17B with reference to the luminaire transverse direction C1, with the result that the connector 40 can be moved along the luminaire longitudinal direction L1.

The first and second securing devices 50A, 50B can each comprise a sliding actuator 54A, 54B, which is connected to the corresponding securing latch 53A, 53B. FIG. 13 shows by way of example the sliding actuator 54B of the second securing device 50B. The sliding actuator 54B can comprise an actuating portion 55B, which at least in the securing state of the securing latch 53B protrudes through a cutout 56 in the connector housing 41. The actuating portion 55B can be in the form of a pushbutton, for example, as shown in particular in FIGS. 9 and 13. The sliding actuator 54B and the second securing latch in particular can be formed as a single part. Alternatively, the sliding actuator 54B and the securing latch 53B can be formed as separate parts that are fixed to one another.

The sliding actuator of the first securing device 50A can have the same design as the sliding actuator 54B of the second securing device 50B. Thus the description of the sliding actuator 54B of the second securing device 50B applies analogously also to the sliding actuator of the first securing device 50A.

The first and second securing devices 50A, 50B can for example each comprise a tensioning means. FIG. 13 shows by way of example a tensioning means 56B for the second securing device 50B. The tensioning means of the first securing device 50A can have the same design as the tensioning means 56B of the second securing device 50B. Thus the following description of the tensioning means 56B of the second securing device 50B applies analogously also to the tensioning means of the first securing device 50A.

The tensioning means 56B of the second securing device 50B tensions the securing latch 53B transverse to the longitudinal extent of the slot 52 of the connector housing 41, in particular in a direction opposite to the connector transverse direction C40, when said securing latch is in its securing position. The tensioning means 56B of the second securing device 50B is kinematically coupled to the securing latch 53B of the second securing device 50B. For this purpose, the tensioning means 56B can be connected to the securing latch 53B itself or to the optional sliding actuator 54B. In particular, the tensioning means 56B can be formed as a single part with the securing latch 53B and/or the sliding actuator 54B. Alternatively, the tensioning means 56B, the securing latch 53B and, if present, the sliding actuator 54B can also be formed each as separate parts that are fixed to one another, for example by adhesive bonding, soldering, welding, screw-fastening or the like.

The tensioning means 56B can be embodied as a curved leaf spring, for example, as shown in FIG. 13. The tensioning means can also be embodied as a helical spring, a resilient plastics part or the like. In general, the tensioning means 56B can be in the form of a resilient component that is coupled kinematically to the securing latch 53B such that it exerts on the securing latch 53B a force which is directed transverse to the longitudinal extent of the slot 52 and which must be overcome in order to move the securing latch 53B out of the securing position into the release position. In particular, the force is directed in an opposite direction to the connector transverse direction C40.

The tensioning means 56B is braced against a support member (not shown), which is spatially fixed with respect to the slot 52 and acts as a counter-bearing to the tensioning means 56B.

In addition, a fastening portion 60 for fastening a retaining cord S can be provided on the connector 40, as shown by way of example in FIGS. 8 to 12. Alternatively or additionally, the fastening portion 60 can be designed for connecting the terminals of an electrical supply cable K. For instance, the fastening portion 60 of the connector 40 can have the same design as the fastening portion 24 of the fastening device 20 shown in FIGS. 1 and 2 and can be intended both for connecting the terminals of an electrical supply cable K and for attaching the retaining cord S. It is also possible that the supply cable K and the retaining cord S are embodied as a single component that performs both the retaining function and the function of making electrical contact.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 10 2016 204 042.1, filed Mar. 11, 2016 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A lighting system comprising:

at least one luminaire having a connection portion, and a fastening device, wherein the fastening device comprises:

a housing;

an electrical contact-making connection, provided for being detachably inserted into a supply connection of the luminaire, which supply connection is formed in the connection portion and complements said electrical contact-making connection;

at least one retaining pin, which protrudes from the housing and has a securing portion, wherein the retaining pin, in a fitted state of the fastening device with the contact-making connection inserted in the supply connection of the luminaire, extends through a slot formed in the connection portion of the luminaire, and the securing portion of the retaining pin is engaged behind a region of the connection portion that defines the slot; and a fastening portion for fastening a retaining cord or for connecting terminals of an electrical supply cable, the fastening portion being coupled to the housing.

2. The lighting system of claim 1, wherein the housing of the fastening device comprises a base support comprising a base and two side walls, which face each other and extend from the base perpendicular thereto in a housing depth direction, and comprises a cover, which cover is joined to the base support and comprises a cover portion that can move along the housing depth direction and is tensioned in the housing depth direction.

3. The lighting system of claim 2, wherein the base support is made of a metal material, and the cover is made of a resiliently deformable plastics material.

4. The lighting system of claim 2, wherein the fastening device comprises a catch, which is formed on a surface of the cover portion of the housing of the fastening device, which surface faces in an opposite direction to the housing depth direction, and protrudes from said surface of the cover portion, wherein in the fitted state of the fastening device, the catch is engaged behind a catch block formed on a connection surface of the connection portion of the luminaire.

5. A lighting system comprising at least two luminaires, wherein a connection portion of a first luminaire can be connected to a connection portion of a second luminaire by a connector, wherein the connector comprises:

a connector housing;

a first electrical contact-making connection and a second electrical contact-making connection, wherein the first and second electrical contact-making connections each have a complimentary design to the supply connection of the corresponding luminaire and can be detachably inserted into said supply connection;

at least one first retaining pin and at least one second retaining pin, wherein the first and second retaining pins each protrude from the connector housing and have a securing portion, wherein in a fitted state of the connector with the first and second contact-making connections of the connector each inserted in the respective supply connections of the first and second luminaires, the first retaining pin extends through a slot formed in the connection portion of the first luminaire, and the securing portion of the first retaining pin is engaged behind a region of the connection portion of the first luminaire, which region defines the slot, and the second retaining pin extends through a slot formed in the connection portion of the second luminaire, and the securing portion of the second retaining pin is engaged behind a region of the connection portion of the second luminaire, which region defines the slot.

6. The lighting system of claim 5, wherein the connector housing comprises a base support comprising a base and two side walls, which face each other and extend from the base perpendicular thereto in a connector depth direction, and comprises a cover piece, wherein said cover piece is joined to the base support.

7. The lighting system of claim 6, wherein the base support of the connector housing is made of a metal material.

8. The lighting system of claim 5, wherein the connector comprises a first securing device and a second securing device, both of which are arranged inside the connector housing and are assigned to a first slot and a second slot respectively formed in the base of the base support of the connector housing, wherein the first and second securing devices each comprise a securing latch that can move transverse to the longitudinal extent of the corresponding slot between a securing position, in which said securing latch protrudes into the corresponding slot, and a release position, in which said securing latch detaches from the slot, wherein in the fitted state of the connector, the securing latch of the first securing device is engaged in its securing position behind the catch block of the connection portion of the first luminaire, and wherein the securing latch of the second securing device is engaged in its securing position behind the catch block of the connection portion of the second luminaire.

9. The lighting system of claim 8, wherein the first and second securing devices each comprise a sliding actuator, which is connected to the corresponding securing latch.

10. The lighting system of claim 8, wherein the first and second securing devices each comprise a tensioning means, which tensions the corresponding securing latch transverse to the longitudinal extent of the corresponding slot of the connector housing when said securing latch is in its securing position.

11. The lighting system of claim 5, wherein the connector comprises a fastening portion for fastening a retaining cord and/or for connecting the terminals of an electrical supply cable.

12. The lighting system of claim 5, wherein the connector is designed as a linear component, wherein the first electrical contact-making portion is arranged at a first end portion of the connector, and the second electrical contact-making portion is arranged at a second end portion of the connector located opposite the first end portion.

13. The lighting system of claim 5, wherein the connector is in the form of an L-shaped component, wherein a first electrical contact-making portion and a second electrical contact-making portion are arranged at least at two free end portions of the connector.

14. The lighting system of claim 5, wherein the connector is in the form of a T-shaped component, wherein a first electrical contact-making portion and a second electrical contact-making portion are arranged at least at two free end portions of the connector.

15. The lighting system of claim 5, wherein the connector is in the form of a component in the shape of a cross, wherein a first electrical contact-making portion and a second electrical contact-making portion are arranged at least at two free end portions of the connector.

16. The lighting system of claim 5, wherein the connector is in the form of a component in the shape of a star, wherein a first electrical contact-making portion and a second electrical contact-making portion are arranged at least at two free end portions of the connector.

* * * * *